US011897715B2

(12) United States Patent
Elliott et al.

(10) Patent No.: US 11,897,715 B2
(45) Date of Patent: Feb. 13, 2024

(54) SENSING ARRANGEMENT FOR A DISPENSER

(71) Applicant: Essity Hygiene and Health Aktiebolag, Gothenburg (SE)

(72) Inventors: Adam T. Elliott, Lexington, KY (US); Christian Kasilag, Philadelphia, PA (US); Don Ward, Philadelphia, PA (US)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 17/596,773

(22) PCT Filed: Nov. 18, 2019

(86) PCT No.: PCT/SE2019/051170
§ 371 (c)(1),
(2) Date: Dec. 17, 2021

(87) PCT Pub. No.: WO2021/101422
PCT Pub. Date: May 27, 2021

(65) Prior Publication Data

US 2022/0267112 A1 Aug. 25, 2022

(51) Int. Cl.
*B65H 23/00* (2006.01)
*A47K 10/36* (2006.01)
(Continued)

(52) U.S. Cl.
CPC ..... *B65H 23/005* (2013.01); *A47K 10/3687* (2013.01); *A47K 10/40* (2013.01);
(Continued)

(58) Field of Classification Search
CPC ..... B65H 23/005; B65H 75/245; A47K 10/3687; A47K 10/40; A47K 2010/3206; A47K 2010/3226
(Continued)

(56) References Cited

U.S. PATENT DOCUMENTS 3,288,387 A * 11/1966 Craven, Jr. ..... A47K 10/3687 242/560.1
4,106,684 A * 8/1978 Hartbauer ..... A47K 10/3637 226/110
(Continued)

FOREIGN PATENT DOCUMENTS

CN 101563012 A 10/2009
CN 112320500 A * 2/2021 ..... B65H 16/005
(Continued)

OTHER PUBLICATIONS

International Preliminary Report on Patentability (PCT/IPEA/409) dated Oct. 28, 2021, by the European Patent Office as the International Searching Authority for International Application No. PCT/SE2019/051170.
(Continued)

*Primary Examiner* — Rakesh Kumar
(74) *Attorney, Agent, or Firm* — BUCHANAN INGERSOLL & ROONEY PC

(57) ABSTRACT

A sensing arrangement for indicating the depletion of a coreless roll of absorbent paper web material in a dispenser, the sensing arrangement includes a roll support for supporting an inner circumference of the coreless roll, the roll support extending along a longitudinal center axis, the roll support comprising at least one roll expanding portion extending over a part of the roll support length and having a maximum radial extension defining a first radius from the center axis, and at least one sensing portion, extending longitudinally over another part of the roll support length and having a maximum radial extension defining a second radius from the center axis, wherein the first radius is greater than the second radius by a sensing offset length, and a sensing element arranged to sense at the sensing portion the
(Continued)

amount of web material remaining on the roll when arranged over the roll support length.

31 Claims, 5 Drawing Sheets

(51) Int. Cl.
*A47K 10/40* (2006.01)
*B65H 75/24* (2006.01)
*A47K 10/32* (2006.01)

(52) U.S. Cl.
CPC .... *B65H 75/245* (2013.01); *A47K 2010/3206* (2013.01); *A47K 2010/3226* (2013.01)

(58) Field of Classification Search
USPC ..... 221/6
See application file for complete search history.

(56) References Cited

U.S. PATENT DOCUMENTS 4,378,912 A * 4/1983 Perrin ..... A47K 10/3637 226/91
4,487,375 A 12/1984 Rasmussen et al.
4,807,824 A * 2/1989 Gains ..... A47K 10/3687 242/560.1
6,152,397 A * 11/2000 Purcell ..... A47K 10/3687 242/563.2
6,517,025 B1 * 2/2003 Budz ..... A47K 10/3818 242/563
6,585,344 B2 * 7/2003 Kolodziej ..... B65H 1/12 271/265.04
8,366,035 B2 * 2/2013 Kling ..... B65H 7/04 242/606
8,599,007 B2 12/2013 Larsson et al.
8,807,475 B2 * 8/2014 Rodrian ..... A47K 10/3845 242/563.2
8,882,021 B2 11/2014 Cittadino et al.
9,648,994 B2 * 5/2017 Cattacin ..... A47K 10/3827
10,682,023 B2 * 6/2020 Holden ..... A47K 10/3836
11,109,721 B2 * 9/2021 Williams, Jr. ..... G07F 9/026
2004/0090332 A1 * 5/2004 Morello ..... G07F 19/201 340/572.8
2006/0217820 A1 * 9/2006 Holt ..... A47K 10/40 700/46
2009/0057169 A1 * 3/2009 Kruchoski ..... A47K 10/40 242/599.1
2009/0057456 A1 * 3/2009 Shannon ..... A47K 10/16 242/160.1
2010/0044407 A1 * 2/2010 Yardley ..... B65H 35/0006 225/14
2013/0099924 A1 * 4/2013 Larsson ..... G08B 21/182 428/411.1
2013/0240554 A1 * 9/2013 Strahlin ..... A47K 10/32 221/6
2014/0367401 A1 * 12/2014 Stralin ..... A47K 10/38 221/6
2015/0097068 A1 * 4/2015 Larson ..... A47K 10/22 242/563
2016/0137398 A1 * 5/2016 Lemke ..... B65H 18/28 206/391
2016/0187484 A1 * 6/2016 Bloomfield ..... B65H 23/1955 250/341.8
2017/0057775 A1 * 3/2017 Kobs ..... A47K 10/3625

FOREIGN PATENT DOCUMENTS

JP 659158760 A 9/1984
RU 2533094 C2 11/2014
RU 2614597 C2 3/2017
WO WO-2009135236 A1 * 11/2009 ..... A47K 10/36

OTHER PUBLICATIONS

International Search Report (PCT/ISA/210) and Written Opinion (PCT/ISA/237) dated Jul. 22, 2020, by the Swedish Patent Office as the International Searching Authority for International Application No. PCT/SE2019/051170.
Office Action (Notification of the First Office Action) dated Jan. 18, 2023, by the Chinese Patent Office in corresponding Chinese Patent Application No. 201980097977.0, and an English Translation of the Office Action. (16 pages).
Office Action dated Nov. 2, 2022, by the Russian Patent Office in corresponding Russian Patent Application No. 2021138368/03(080375), and an English Translation of the Office Action. (14 pages).
Examination Report dated May 16, 2023, by the Chilean Patent Office in corresponding Chilean Patent Application No. 202200159 and English translation of the Report. (12 pages).
English language version of Office Action/Written Opinion dated Sep. 12, 2023, in corresponding Brazilian Patent Application No. BR112021025976-7. (4 pages).
Office Action (Notification of the Third Office Action) dated Oct. 19, 2023, in corresponding Chinese Patent Application No. 201980097977.0 and English translation of the Office Action. (7 pages).

* cited by examiner

SENSING ARRANGEMENT FOR A DISPENSER

TECHNICAL FIELD

The present disclosure relates to a sensing arrangement for indicating the depletion of a coreless roll of absorbent paper web material in a dispenser, the sensing arrangement comprising a roll support, configured for supporting an inner circumference of said coreless roll over a roll support length, and a sensing element arranged to sense the amount of web material remaining on the roll arranged over said roll support length. The disclosure also relates to a dispenser comprising such a sensing arrangement.

BACKGROUND

A dispenser for rolls of absorbent paper web material, such as hygiene paper or wiping paper, may comprise a housing configured to house at least two rolls. In such dispensers it may generally be desired that absorbent paper is initially dispensed from one out of the two rolls, and that absorbent paper from the other roll is presented to the user only once the first roll is completely or close to depleted.

To this end, existing dispensers may comprise a sensing arrangement for sensing when a first roll is depleted or close to depleted. When the sensing arrangement detects that a roll is depleted or close to depleted, dispensing from a new roll may be allowed or activated.

The roll deemed depleted is discarded. Present sensing arrangements present limits in accuracy, meaning that often a small amount of web material remains on the roll which is deemed depleted and then discarded. With a large numbers of dispensers in use and/or over a long period of time, the discarded amount of web material may become significant.

Hence, it is desired to provide a sensing arrangement for indicating the depletion of a coreless roll of absorbent paper web material in a dispenser which provides for improved accuracy.

SUMMARY

Hence, there is provided a sensing arrangement for indicating the depletion of a coreless roll of absorbent paper web material in a dispenser, the sensing arrangement comprising a roll support, configured for supporting an inner circumference of said coreless roll with said roll extending over a roll support length, said roll support extending along a longitudinal centre axis. The roll support comprises at least one roll expanding portion extending over a part of said roll support length and having a maximum radial extension defining a first radius from said centre axis, and at least one sensing portion, extending longitudinally over another part of said roll support length and having a maximum radial extension defining a second radius from said centre axis, wherein said first radius is greater than said second radius by a sensing offset length, a sensing element arranged to sense at said sensing portion the amount of web material remaining on the roll when arranged over said roll support length.

As such, the sensing arrangement enables that the last few windings of web material remaining on a close to depleted roll will, by action of the roll expanding portion(s) of the roll support, be held at a radius from the centre axis of the roll support being the first radius r1. The sensing element is arranged to sense the amount of web material at the sensing portion. Ideally, when some windings of web material remain on the roll, this means that also at the sensing portion, the windings are held at a distance from the centre axis of the roll support being the first radius r1, which location may be sensed by the sensing element. Then, as the last windings are depleted, the sensing element will sense the location of the sensing portion having the second radius r2 from the centre axis of the roll support, being less than the first radius r1. Hence, at final depletion of the roll, the sensing element moves over a distance being the offset distance r1-r2.

The offset distance hence provides a length which is used by the sensing element for indicating the difference between a close to depleted and a completely depleted roll. An increased length for sensing, i.e. an increased offset distance, provides for better accuracy when measuring.

For example, with a sensing arrangement as proposed herein, the offset length may be greater than 2 mm, preferably greater than 4 mm. This may be compared to a sensing system where the sensing element is arranged to be biased towards a roll support with no such offset distance, where the final depletion of the roll, i.e. the difference between some last few windings of web material remaining on the roll and complete depletion, may involve the sensing element sensing a difference over a length corresponding only to the thickness of those last few windings of web material. (Which may e.g. be less than 0.2 mm).

Although in ideal conditions, the last windings of web material on the roll extending over the sensing portion would be held at a distance being the first radius r1 from the centre axis, in practice, the last windings of web material extending over the sensing portion may yield slightly towards the sensing portion. For example, this may be the case when the sensing element applies a pressure towards the windings extending over the sensing portion. Still, with the sensing arrangement proposed herein, the difference in location relative to the centre axis between the last windings of web material when slightly pushed towards the sensing element and the second radius of the sensing portion (that is a completely depleted roll), will be available for sensing and provide an increased sensing length.

In view of the above, the size of the offset length to be selected may be determined taking e.g. properties of the web material into account, such as the strength or the web material.

In particular, the sensing arrangement may be a sensing arrangement for indicating the depletion of a coreless roll of absorbent paper web material in a dispenser, configured for dispensing of absorbent paper web material from an outer circumference of said coreless roll.

That the roll support is configured for supporting an inner circumference of said coreless roll with said roll extending over a roll support length implies that the roll support length is a length corresponding to the length of the roll, and over which the roll extends when applied to the roll support. However, it is not necessary that the entire roll support length of the roll support actively supports the roll. For example, the sensing portion will, during most part of the dispensing, not be in contact with the inner circumference of a roll applied on the roll support. Instead, the roll expanding portion(s) will (at the first radius r1) contact the inner circumference of a roll.

The roll support may optionally be formed by a single elongate member having a length corresponding at least to the roll support length.

Optionally, the roll support may be formed by a plurality of separate members which in an assembled condition form a single elongate member having a length corresponding at least to the roll support length.

Optionally, the roll support may be formed by a plurality of separate members which are configured to leave an open gap between said members. For example, the roll support may be formed by two separate members which are configured to support the roll from each longitudinal side thereof, leaving an open gap between said members. As such, said sensing portion may be formed by said open gap between said members. In this case, said second radius of the sensing portion would be defined as being zero.

Optionally, said roll support comprises at least a first roll expanding portion and a second roll expanding portion. Each of the first and second roll expanding portions extends over a part of said roll support length, and has a maximum radial extension defining a radius from the centre axis being greater than the second radius of the sensing portion, and the first and second roll expanding portions are separated by the sensing portion.

Thus, the last few windings of web material on a roll will be spanned over the sensing portion by means of the first and second roll expanding portions.

Optionally, the first and second roll expanding portions both have said maximum radial extension defining said first radius from the centre axis being greater than the second radius of the sensing portion.

It is to be understood, that any number of roll expanding portions and roll sensing portions may be provided at the roll support.

Optionally, said roll expanding portion(s) comprises at least one roll expanding member, providing said first radius.

Optionally, the roll expanding member(s) may be formed integrally with the remainder of the roll support.

Optionally, the roll expanding member(s) may be formed as a separate part(s) which is (are) assembled to a roll support base portion to form the roll support.

Optionally, said at least one roll expanding member extends along a complete circumference about the longitudinal axis of the roll support. For example, the roll expanding member may form a ring about the roll support, which ring protrudes radially to provide the first radius.

Optionally, the roll expanding portion(s) comprises a plurality of roll expanding members, said roll expanding members being distributed over a circumference about the longitudinal axis of the roll support. As such, the roll expanding portion(s) may comprise at least two roll expanding members, or at least three roll expanding members, or even at least four roll expanding members. The roll expanding members may be distributed over the circumference of the roll support so as to span the inner circumference of a roll. For example, pairs of roll expanding members may be arranged in radially opposite positions.

Optionally, said roll expanding member(s) is (are) rigid. As such, the roll expanding member will constantly provide the first radius from the centre axis, e.g. when a new roll is applied to the roll support or when the roll is close to depleted.

Optionally, said roll expanding member(s) is (are) resilient.

Resilient roll expanding members may deflect and/or compress when a roll is initially loaded onto the roll support. This may be due to a difference between the inner radius of the roll and the second radius r2. Such a difference may be intentional, but furthermore, the inner circumference of the coreless roll may be collapsed or deformed. The resilient members enable that a roll may be applied on the roll support even when the inner circumference of the roll is collapsed or deformed.

When only a few windings of web material remain on the roll support, the resilient members will apply a biasing force towards the inner circumference of the web material being great enough to expand the roll to its original (or close to its original) inner diameter. Accordingly, the offset distance (or at least a sufficient part of the offset distance) will be available for sensing.

In view of the above, it is to be understood that the roll expanding members being resilient is to be understood in terms of the forces relevant for the situation where a roll is applied on a roll support.

The roll expanding members may be configured so as to yield sufficiently to allow even a partly collapsed roll to be arranged to the roll support, but to still create an offset distance available for sensing when only a few windings remain of the roll. To this end, the roll expanding members may re-expand as the roll is depleted.

Optionally, said roll expanding member(s) is/are resilient at least in a radial direction of the roll support. The roll expanding members being resilient in a radial direction is to say that that they yield when subject to a force applied from a radial direction of the roll support to the centre axis.

Optionally, said roll expanding member(s) is/are resilient at least in a longitudinal direction of the roll support. The roll expanding members being resilient in a longitudinal direction is to say that they yield when subject to a force applied from a direction parallel to the centre axis.

Optionally, resilient roll expanding members may be made from a material being non-deformable e.g. hard plastic, such as for example PP. In this case, the resiliency may be accomplished by the design of the expanding members, e.g. by forming protruding ribs or similar structures. This option allows for the entire roll support to be moulded in one piece, e.g. from PP plastics.

Optionally, resilient roll expanding members may be made from a deformable material. For example, the resilient roll expanding members may be made by elastomer type materials or rubber type materials. For example, the material could be TPE.

When arranging a roll on the roll support, the roll will typically be slid over the roll support in a longitudinal direction. To this end, the coefficient of friction of the material of the roll expanding member (resilient or not) should preferably be relatively low, such that the roll expanding members do not hinder the application of a roll on the roll support. This is in particular to be noted when it comes to rubber type materials.

Optionally, said sensing portion extends longitudinally over a part of said roll support length (L) being less than 50% of the roll support length (L) preferably less than 40%.

Optionally, the sensing element is arranged to sense the amount of web material remaining on the roll by indicating a minimum distance between the sensing element and the second radius of said sensing portion.

Optionally, the sensing element is a mechanical sensing element, preferably said sensing element is pivotably arranged so as to be pivoted towards said sensing portion of said roll support.

Optionally, said sensing element is arranged to be biased towards said sensing portion of the roll support.

As such, the sensing element being biased towards the sensing portion of the roll support, implies the sensing element applying a pressure to the windings of web material of the roll at the sensing portion in a direction towards the centre axis of the roll support.

Optionally, the sensing element is configured to indicate that the roll is depleted when the sensing element is within a threshold distance from said sensing portion. Optionally, said threshold distance is equal to the offset distance. Optionally, and preferred, the threshold distance is less than the offset distance.

Optionally, the sensing element is configured to indicate that the roll is depleted when the sensing element contacts said sensing portion of the roll support. In other words, when the sensing element is within a threshold distance from said sensing portion, the threshold distance is zero.

Optionally, the sensing element is arranged so as to contact a perimeter of a portion of the roll arranged to extend over the sensing portion.

Optionally, the sensing element is arranged to be spaced from contact with the perimeter of a portion (or portions) of the roll arranged to extend over said roll expanding portion(s).

Optionally, the sensing element is arranged to be spaced from contact with a perimeter of a roll arranged over the roll support length at any portions of the roll other than a portion arranged to extend over the sensing portion of the roll support. As such, sensing at the sensing portion is ensured.

In a second aspect, there is provided a dispenser comprising a sensing arrangement as described herein.

Optionally, said sensing arrangement is arranged so as to trigger an indication providing information that the roll arranged on the roll support is depleted. Said indication may for example be an audible or visual signal indicating to an attendant that the dispenser needs to be replenished. Also, said indication may be a data signal e.g. to a computer, mobile phone or other digital device, for transferring the information that the dispenser need to be replenished.

Optionally, said sensing arrangement is arranged so as to control the start of dispensing from a stored, unused roll in said dispenser, upon the sensing element indicating that the roll carried by the support element is depleted.

Optionally, said sensing arrangement is arranged to control a trigger arrangement so as to trigger automatic replenishing of a depleted roll with a stored, unused roll in said dispenser, upon the sensing element indicating that the roll carried by the support element is depleted.

Optionally, the sensing arrangement is arranged to control to a door arrangement so as to allow moving of a lid so as to allow dispensing from a stored, unused roll in said dispenser, upon the sensing element indicating that the roll carried by the support element is depleted.

Optionally, the sensing arrangement is arranged to activate an electronic switch. The electronic switch may be arranged so as to control the start of dispensing from a new unused roll, e.g. via a trigger arrangement or a door arrangement as mentioned in the above. Optionally the electronic switch may be arranged so as to control the start of dispensing from a new unused roll by activating a feeding arrangement for feeding web material from the new roll.

Optionally, the sensing arrangement is arranged to activate a mechanical switch. The mechanical switch may be arranged so as to control the start of dispensing from a new unused roll, e.g. via a trigger arrangement or a door arrangement as mentioned in the above. Optionally the mechanical switch may be arranged so as to control the start of dispensing from a new unused roll by activating a feeding arrangement for feeding web material from the new roll.

In a third aspect, there is provided a method for arranging a coreless roll of absorbent paper web material on a roll support comprised in a sensing arrangement as described herein and/or in a dispenser as described herein. The method comprises the step of:—arranging said coreless roll on said roll support such that said roll support supports an inner circumference of said roll and said roll extends over said roll support length.

Further, it is provided a sensing arrangement and/or a dispensing arrangement as described herein, comprising a coreless roll arranged on said roll support such that said roll support supports an inner circumference of said roll and said roll extends over said roll support length. In this case, the sensing element may be arranged to sense at said sensing portion the amount of web material remaining on said roll.

Further options and advantages of the dispenser as disclosed herein are disclosed in the following description.

BRIEF DESCRIPTION OF THE DRAWINGS

Below follows a more detailed description of an exemplary embodiment of sensing arrangements with reference to the appended drawings, wherein.

Like reference numbers denote similar features throughout the figures.

DETAILED DESCRIPTION OF PREFERRED EMBODIMENTS

Figure 1:
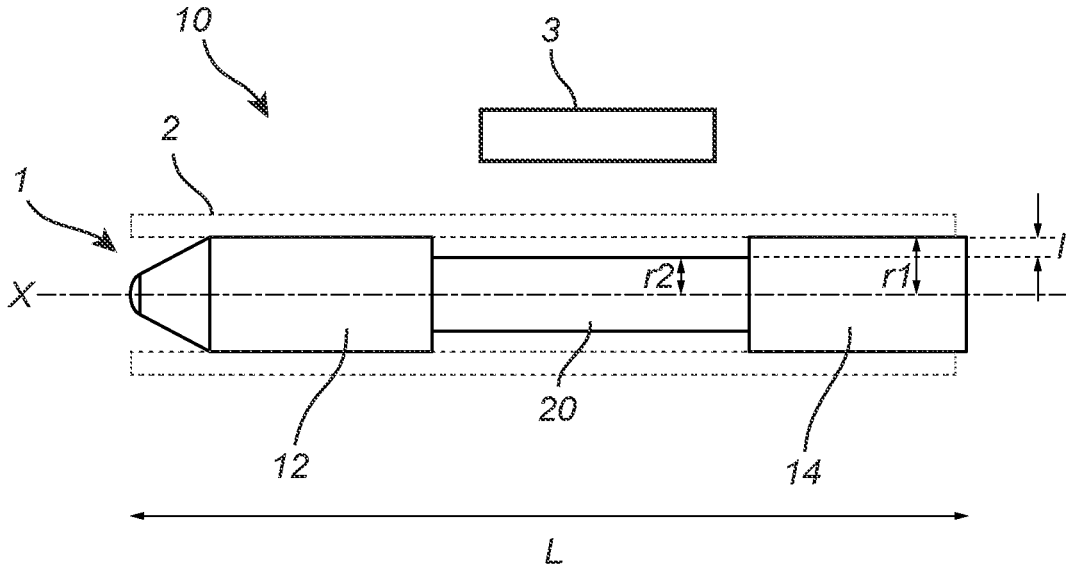
FIG. 1 illustrates schematically a first variant of a sensing arrangement.

FIG. 1 illustrates schematically a first variant of a sensing arrangement 10 for indicating the depletion of a coreless roll of absorbent paper web material in a dispenser. The sensing arrangement 10 comprises a roll support 1, configured for supporting an inner circumference of said coreless roll 2 over a roll support length L. The roll support 1 extends along a longitudinal centre axis X.

In the illustrated variants, the roll support 1 forms a continuous elongated member, configured for application of a roll 2 from a longitudinal end thereof. However, it is envisaged that roll supports 1 may be formed by a plurality of separate members. Preferably, in a use state, the roll support 1 is continuous along the roll support length.

The roll support 1 comprises at least one roll expanding portion 12, 14 extending over a part of said roll support length L and having a maximum radial extension defining a first radius r1 from said centre axis X.

Optionally, and as in the illustrated embodiment, the roll support 1 comprises a first roll expanding portion 12 and a second roll expanding portion 14, and each of the first and second roll expanding portions extends over a part of said roll support length L and has a maximum radial extension defining said first radius r1 from said centre axis X.

The roll support 1 further comprises at least one sensing portion 20, extending longitudinally over another part of said roll support length L and having a maximum radial extension defining a second radius r2 from said centre axis X, wherein said first radius r1 is greater than said second radius r2 by a sensing offset length l.

In the illustrated variant, the first and second roll expanding portions 12, 14 are separated by said sensing portion 20.

Further, a sensing element 3 is arranged to sense the amount of web material remaining on the roll 2 arranged over said roll support length L at said sensing portion 20.

As explained in summary section of the application in the above, the provision of the offset length l allows for increased accuracy when detecting the depletion of a roll 2 arranged on the roll support 1.

Optionally, the sensing portion 20 extends longitudinally over a part of said roll support length L being less than 50% of the roll support length L preferably less than 40%.

In FIG. 1, the sensing portion 20 extends longitudinally over a part of said roll support length being about ⅓ of the roll support length l.

The sensing element 3 is arranged to sense the amount of web material remaining on the roll 2 by indicating a minimum distance between the sensing element 3 and the second radius of said sensing portion 20.

Optionally, and in the illustrated variants, the sensing element 3 is a mechanical sensing element, preferably said sensing element is pivotably arranged so as to be pivoted towards said sensing portion 20 of said roll support 1.

Optionally, and in the illustrated variants, the sensing element 3 is arranged to be biased towards said sensing portion 20 of the roll support 1.

The said sensing element may be configured to indicate that the roll 2 is depleted when the sensing element 3 is within a threshold distance from said sensing portion 20. Optionally, said sensing element 3 may be configured to indicate that the roll 2 is depleted when the sensing element 3 contacts said sensing portion 20 of the roll support 1.

When the sensing element 3 is arranged so as to be pivoted towards the sensing portion of the roll support 1, a threshold distance translates into a threshold degree of pivoting.

As seen in FIG. 1, in this variant the roll expanding portions 12, 14 are essentially cylindrical, providing said first radius r1 over a length along the central axis X of the roll support 1.

Figure 2:
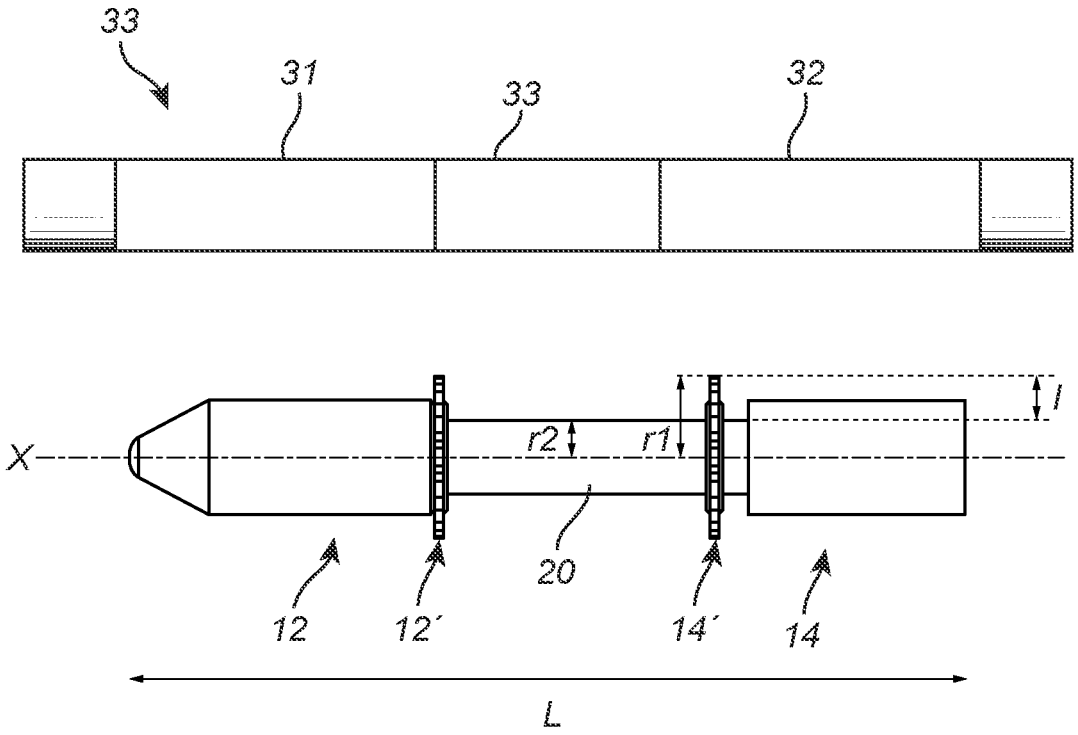
FIG. 2 illustrates schematically a second variant of a sensing arrangement.

FIG. 2 illustrates schematically a second variant of a sensing arrangement 10.

In this second variant the roll expanding portions 12, 14 each comprises a roll expanding member 12' 14'. The roll expanding members 12, 14' provides the first radius r1.

Figure 3A:
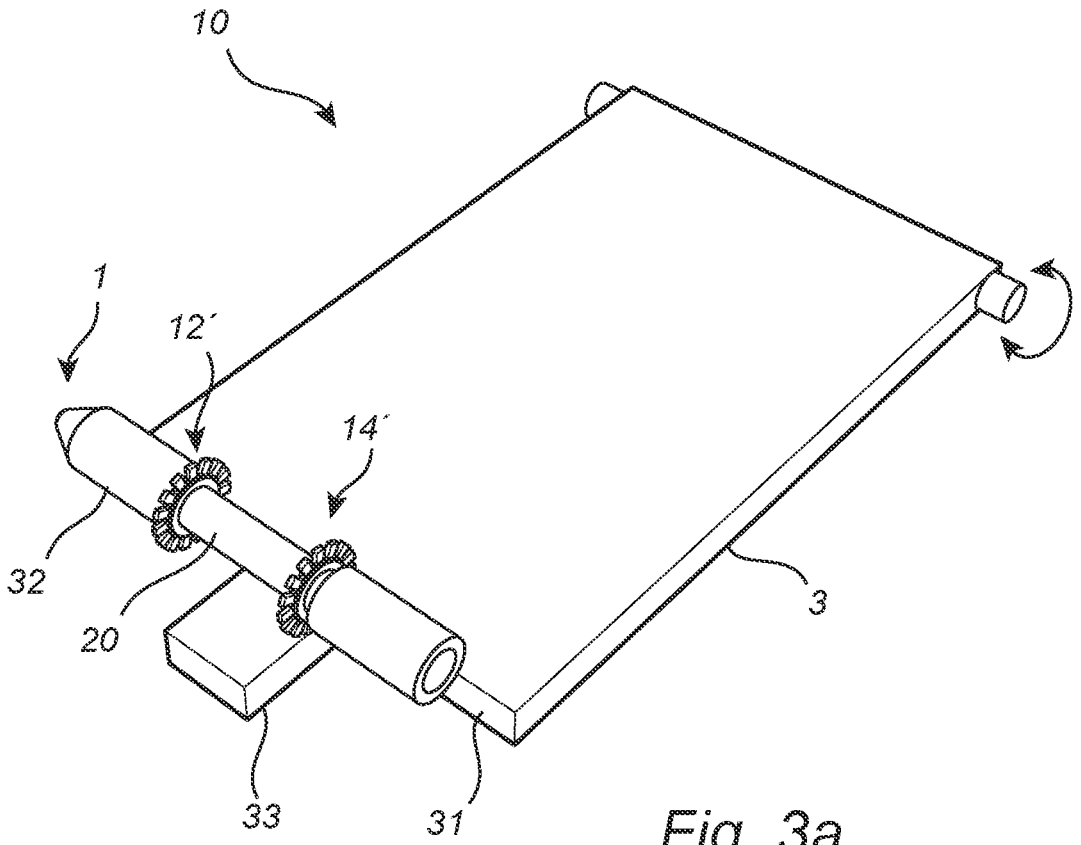
FIG. 3*a* illustrates schematically the second variant of a sensing arrangement in a perspective view.
Figure 3B:
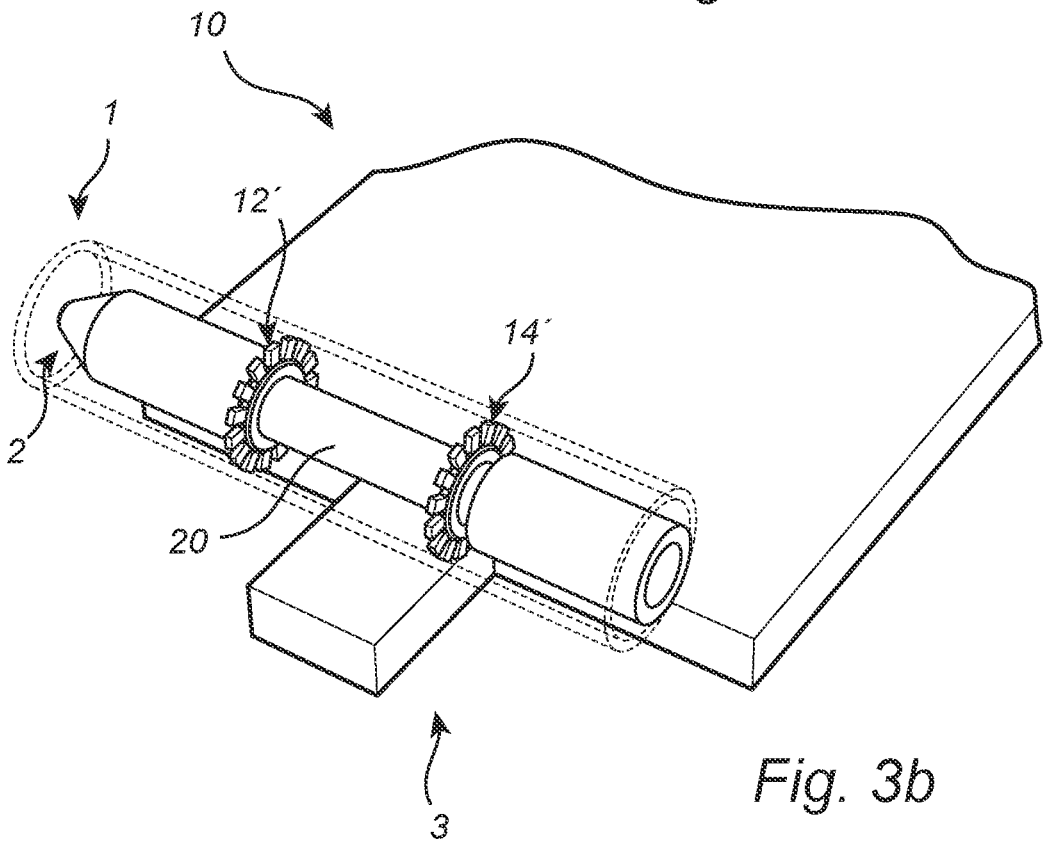
FIG. 3*b* illustrates schematically the second variant of a sensing arrangement in a perspective view, and with a partly used roll of web material arranged to it.

FIG. 3*a* illustrates schematically the second variant of a sensing arrangement in a perspective view, and FIG. 3*b* illustrates schematically the second variant of a sensing arrangement in a perspective view, and with a partly used roll of web material 2 arranged to it.

In FIGS. 2 to 3*b* it is seen how in this variant the sensing element 3 is in the form of a sensing paddle, which may advantageously be pivotably arranged in relation to the roll support 1. The arrow in FIG. 3*a* illustrates the pivot axis. The sensing element comprises a protruding portion 33, which is arranged so as to sense the amount of material on a roll 2 arranged over the sensing portion 20 of the roll support 1. On each side of the protruding portion 33, the sensing element extends with side portions 32 and 31. As may be gleaned from the figures, the side portions 32 and 31 are configured so as to be spaced from the roll support 1. In other words, the sensing element 3 is arranged so as to sense the amount of material remaining over the sensing portion 20 only (via the protrusion 33). The sensing element 3 is arranged so as to be spaced from portions of the roll support 1 other than the sensing portion 20.

In the second variant of the dispenser as illustrated in FIG. 2-3*b*, the roll expanding members 12', 14' extend along a complete circumference about the longitudinal axis of the roll support 1. In particular, the roll expanding members 12', 14' are ring-shaped members. In the illustrated embodiment, the ring-shaped members are further provided with ribs extending radially about the ring-shaped members, so as to provide the first radius r1.

As will be further described in the below, roll expanding members may be provided in a number of varieties and shapes.

Optionally, the roll expanding members are rigid, as discussed in the above summary section.

Optionally, and as in the variant described in FIGS. 2 to 3*b*, the said roll expanding members are resilient, as discussed in the above summary section.

In particular, by means of the above-mentioned radially extending ribs, the roll expanding members 12', 14' may be resilient in a radial direction and in a longitudinal direction of the roll support.

In particular, if a roll 2 having a deformed inner circumference (meaning that the inner windings of the roll are deformed and not expanded to a maximum circumference) is applied over the roll support 1 by threading the roll 2 in a direction along the centre axis X, the roll expanding member 12', 14' may yield and bend so as to enable arrangement of the roll 2 on the roll support 1. However, when only a few windings remain on the roll 2, the roll expanding members 12', 14' striving to reassume their original shape may push the last few windings outwards, so as to expand the roll 2. Accordingly, the offset distance I or at least a substantial portion of the offset distance I will be available for sensing.

In this second variant, the said roll expanding members may be made eg. from an elastomer type material or a rubber type material.

Figure 4A:
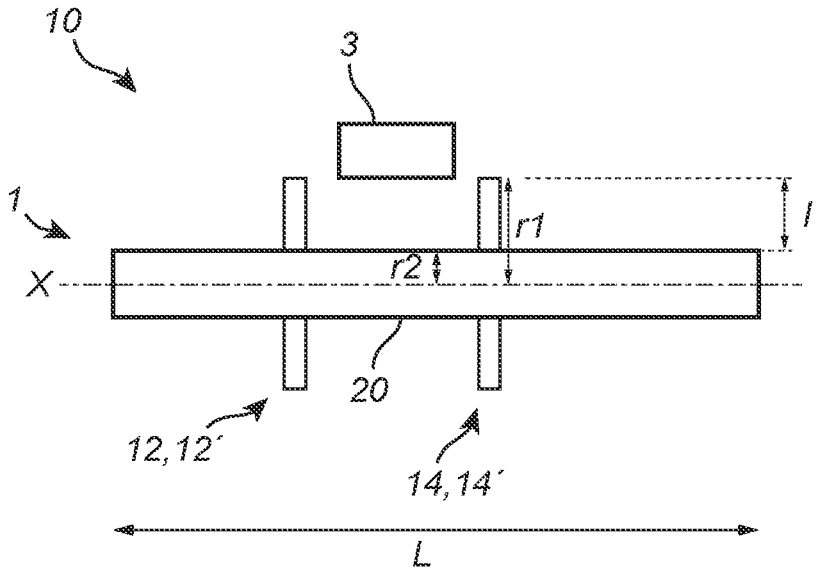
FIGS. 4*a* to 4*c* illustrate schematically a third and a fourth variant of a sensing arrangement.
Figure 4B:
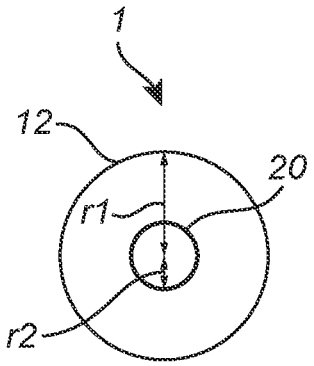

FIGS. 4*a* and 4*b* illustrate another variant of a sensing arrangement 10, wherein the roll support 1 comprises a first and a second roll expanding member 12', 14', providing said first radius r1.

In this case, the extension of the first and second roll expanding members 12', 14' correspond to the extension of the first and second roll expanding portions 12, 14.

FIG. 4*b* is a side view as seen from a cut through the roll sensing portion 20 of the roll support 1 of FIG. 4*a*. In FIG. 4*b*, the roll expanding members 12', 14' extend circumferentially about the circumference of the roll support 1. In particular, the roll expanding members 12', 14' are ring-shaped members.

Figure 4C:
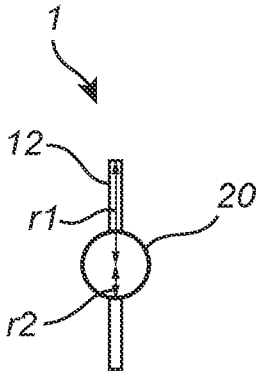

FIG. 4*c* is a similar side view as seen from a cut through the roll sensing portion 20 of the roll support 1 of FIG. 4*a*, illustrating another variant of a roll support 1. In this variant, each roll expanding portion 12, 14 comprises a plurality of roll expanding members 12', 14', said roll expanding members 12', 14' being distributed over a circumference about the longitudinal axis of the roll support. Optionally, and as in the illustrated variant, each roll expanding portion 12, 14 comprises two roll expanding members 12', 14', being arranged in an opposed radial relationship.

Figure 5A:
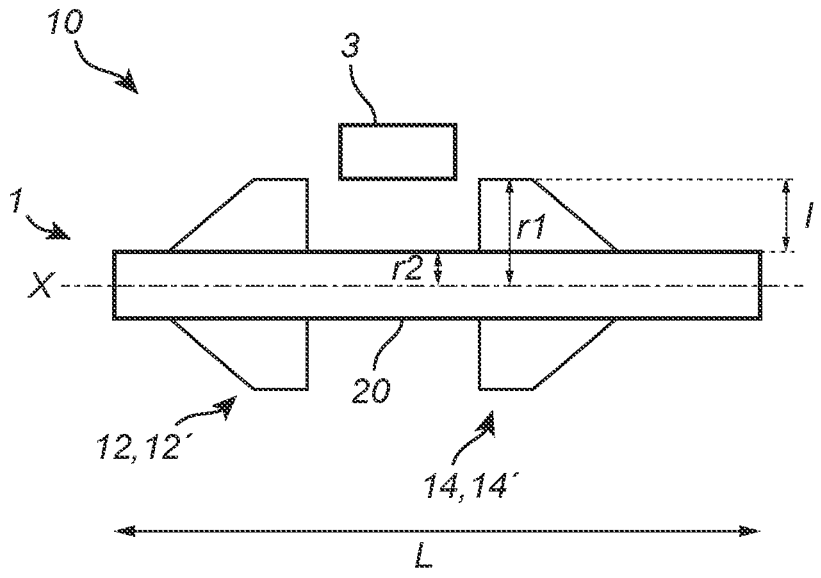
FIGS. 5*a* and 5*b* illustrate schematically a fifth variant of a sensing arrangement.
Figure 5B:
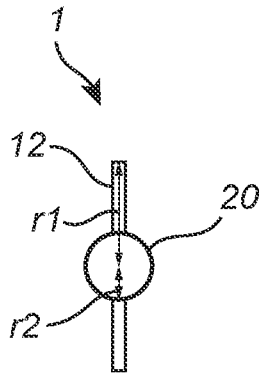

FIGS. 5*a* and 5*b* illustrate another variant of a sensing arrangement, with a roll support 1 being provided with roll expanding members 12', 14'. In this embodiment, the roll expanding members 12', 14' are arranged to form a ramp surface, hence having a radius from the centre axis which increases from the longitudinal ends of the roll support towards the centre thereof. As seen in FIG. 5*b*, each roll expanding portion 12, 14 comprises two roll expanding members 12', 14', being arranged in an opposed radial relationship.

The different variants of roll sensing arrangements as described in the above may be varied in multiple ways. For example, the variants of FIGS. 4*c* and 5*b* may be varied by the roll expanding portions 12, 14 being provided with more than two roll expanding members 12', 14', for example three or four roll expanding members 12, 14'.

In particular, even if the roll expanding members 12', 14' exemplified in FIGS. 4*a*-5*b* extend perpendicular to the centre axis X, in other variants the roll expanding members 12', 14' may be inclined in relation to the centre axis X. Moreover, the roll expanding members 12', 14', need not be straight but could be e.g. curved.

The roll expanding members 12', 14' as described in relation to the Figures and as otherwise outlined herein may be configured to be rigid or to be resilient.

Figure 6A:
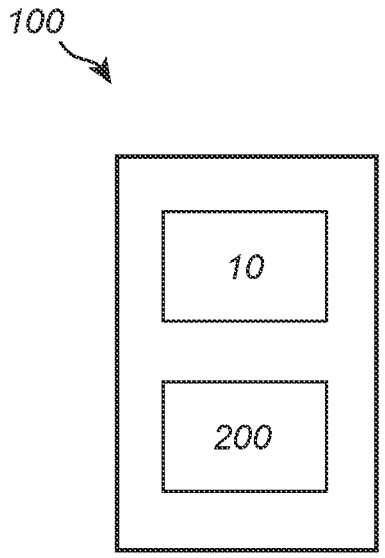
FIGS. 6*a* and 6*b* illustrate schematically two variants of dispensers having a sensing arrangement as described herein.
Figure 6B:
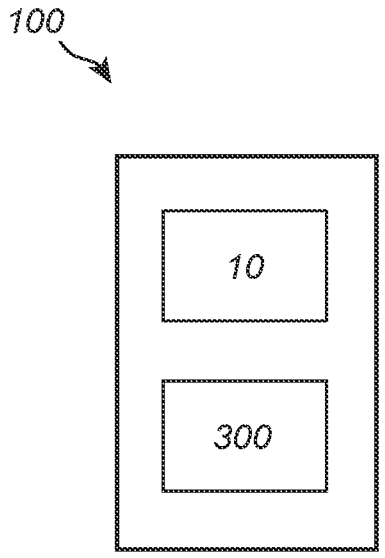

FIGS. 6*a* and 6*b* illustrate schematically two variants of dispensers having a sensing arrangement as described herein.

It will be understood that the sensing arrangement as described herein may be used in a large variety of dispensers.

In particular, and as in the illustrated dispensers, a dispenser 100 may be provided wherein the sensing arrangement 10 is arranged so as to control the start of dispensing from a new, unused roll in said dispenser 100, upon the sensing element 3 indicating that the roll carried by the support element 1 is depleted.

Optionally, and as in FIG. 6*a*, the sensing arrangement 10 is arranged to control a trigger arrangement 200 so as to trigger automatic replenishing of a depleted roll with stored, unused roll in said dispenser, upon the sensing element 3 indicating that the roll 2 carried by the support element 1 is depleted.

Optionally, and as in FIG. 6*b*, the sensing arrangement 10 is arranged to control to a door arrangement 300 so as to allow moving of a lid so as to allow dispensing from a new, unused roll in said dispenser, upon the sensing element 3 indicating that the roll carried by the support element 1 is depleted.

In another option, the sensing arrangement 10 may be arranged to control the feeding of web material from a new, unused roll.

The sensing arrangement 10 may be arranged to activate an electronic switch or alternatively to activate a mechanical switch.

In a method for arranging a coreless roll 2 of absorbent paper web material on a roll support 1 comprised in a sensing arrangement 10 and/or in a dispenser 100 as described herein, the method comprises the step of arranging said coreless roll 2 on said roll support 1 such that said roll support 1 supports an inner circumference of said roll 2 and said roll 2 extends over said roll support length L.

Optionally, and as in the illustrated variants, the coreless roll 2 may be threaded over the roll support 1 from a longitudinal end of the roll support 1. However, in variants where the roll support 1 comprises a plurality of separate members, the roll 2 may be threaded over the separate members from the two longitudinal ends of the roll support 1. That the roll 2 is threaded over a roll support 1 or over separate members of a roll support 1 implies a relative movement between the roll 2 and the roll support (members) 1, including that either or both of the roll support 1 and the roll 2 is/are moved.

Numerous variants and options of the dispensers disclosed here will be conceivable by the person skilled in the art.

The invention claimed is:

1. A sensing arrangement for indicating the depletion of a coreless roll of absorbent paper web material in a dispenser, the sensing arrangement comprising:

a roll support configured to be inserted into an inner circumference of said coreless roll with said roll extending over a roll support length so as to support said coreless roll, said roll support extending along a longitudinal center axis, the roll support comprising:

at least one roll expanding portion extending over a part of said roll support length and having a maximum radial extension defining a first radius from said center axis, and at least one sensing portion, extending longitudinally over another part of said roll support length and having a maximum radial extension defining a second radius from said center axis, wherein said first radius is greater than said second radius by a sensing offset length, and a sensing element configured to sense that the web material remaining on the roll is depleted when a distance between the sensing element and the sensing portion becomes less than the first radius, wherein said sensing element is a mechanical sensing element that is pivotably arranged so as to be pivoted towards said sensing portion of said roll support.

2. The sensing arrangement according to claim 1, wherein said roll support comprises at least a first roll expanding portion and a second roll expanding portion, each of said first and second roll expanding portions extending over a part of said roll support length and having a maximum radial extension defining said first radius from said center axis, said first and second roll expanding portions being separated by said sensing portion.

3. The sensing arrangement according to claim 1, wherein said sensing portion extends longitudinally over a part of said roll support length being less than 50% of the roll support length.

4. The sensing arrangement according to claim 1, wherein said sensing element is arranged to sense the amount of web material remaining on the roll by indicating a minimum distance between the sensing element and the second radius of said sensing portion.

5. The sensing arrangement according to claim 1, wherein said sensing element is a mechanical sensing element that is pivotably arranged so as to be pivoted towards said sensing portion of said roll support.

6. The sensing arrangement according to claim 1, wherein said sensing element is arranged to be biased towards said sensing portion of the roll support.

7. The sensing arrangement according to claim 1, wherein said sensing element is configured to indicate that the roll is depleted when the sensing element is within a threshold distance from said sensing portion.

8. The sensing arrangement according to claim 1, wherein said sensing element is configured to indicate that the roll is depleted when the sensing element contacts said sensing portion of the roll support.

9. The sensing arrangement according to claim 1, wherein said sensing element is arranged so as to contact a perimeter of a portion of the roll arranged to extend over said sensing portion.

10. The sensing arrangement according to claim 1, wherein said sensing element is arranged to be spaced from contact with the perimeter of a portion of the roll arranged to extend over said at least one roll expanding portion to be spaced from contact with a the perimeter of the roll arranged over the roll support length at any portions other than a portion arranged to extend over the sensing portion of the roll support.

11. The sensing arrangement according to claim 1, wherein said at least one roll expanding portion comprises at least one roll expanding member, providing said first radius, wherein said at least one roll expanding member is resilient.

12. The sensing arrangement according to claim 11, wherein said at least one roll expanding member extends along a complete circumference about the longitudinal axis of the roll support.

13. The sensing arrangement according to claim 11, wherein said at least one roll expanding portion comprises a plurality of roll expanding members, said roll expanding members being distributed over a circumference about the longitudinal axis of the roll support.

14. The sensing arrangement according to claim 11, wherein said at least one roll expanding member is resilient at least in a radial direction of the roll support.

15. The sensing arrangement according to claim 11, wherein said at least one roll expanding member is resilient at least in a longitudinal direction of the roll support.

16. The sensing arrangement according to claim 11, wherein said roll expanding members are made from a deformable material.

17. The sensing arrangement according to claim 1, wherein said at least one roll expanding portion extends along a complete circumference about the longitudinal axis of the roll support.

18. The sensing arrangement according to claim 1, wherein said at least one roll expanding portion comprises a plurality of roll expanding portions, said roll expanding portions being distributed over a circumference about the longitudinal axis of the roll support.

19. The sensing arrangement according to claim 1, wherein the sensing element includes a protruding portion that is configured to contact with the coreless roll when the coreless roll is in the dispenser, and the protruding portion pivots about an axis that is parallel to the roll support.

20. A dispenser for dispensing a coreless roll of absorbent paper, the dispenser comprising:

a sensing arrangement for indicating the depletion of a coreless roll of absorbent paper web material in a dispenser, the sensing arrangement comprising:

a roll support configured to be inserted into an inner circumference of said coreless roll with said roll extending over a roll support length so as to support said coreless roll, said roll support extending along a longitudinal center axis, the roll support comprising:

at least one roll expanding portion extending over a part of said roll support length and having a maximum radial extension defining a first radius from said center axis, and at least one sensing portion, extending longitudinally over another part of said roll support length and having a maximum radial extension defining a second radius from said center axis, wherein said first radius is greater than said second radius by a sensing offset length, and a sensing element configured to sense that the web material remaining on the roll is depleted when a distance between the sensing element and the sensing portion becomes less than the first radius, wherein said sensing element is a mechanical sensing element that is pivotably arranged so as to be pivoted towards said sensing portion of said roll support.

21. The dispenser according to claim 20, wherein the sensing arrangement is arranged so as to trigger an indication providing information that the roll arranged on the roll support is depleted.

22. The dispenser according to claim 20, wherein said sensing arrangement is arranged so as to control the start of dispensing from a stored, unused roll in said dispenser, upon the sensing element indicating that the roll carried by the support element is depleted.

23. The dispenser according to claim 20, wherein said sensing arrangement is arranged to control a trigger arrangement so as to trigger automatic replenishing of a depleted roll with stored, unused roll in said dispenser, upon the sensing element indicating that the roll carried by the support element is depleted.

24. The dispenser according to claim 20, wherein the sensing arrangement is arranged to control to a door arrangement so as to allow moving of a lid so as to allow dispensing from a stored, unused roll in said dispenser, upon the sensing element indicating that the roll carried by the support element is depleted.

25. The dispenser according to claim 20, wherein the sensing arrangement is arranged to activate an electronic switch.

26. The dispenser according to claim 20, wherein the sensing arrangement is arranged to activate a mechanical switch.

27. A method for arranging a coreless roll of absorbent paper web material on a roll support comprised in a sensing arrangement for indicating depletion of a coreless roll of absorbent paper web material in a dispenser, the sensing arrangement comprising:

a roll support configured to be inserted into an inner circumference of said coreless roll with said roll extending over a roll support length so as to support said coreless roll, said roll support extending along a longitudinal center axis, the roll support comprising:

at least one roll expanding portion extending over a part of said roll support length and having a maximum radial extension defining a first radius from said center axis, and at least one sensing portion, extending longitudinally over another part of said roll support length and having a maximum radial extension defining a second radius from said center axis, wherein said first radius is greater than said second radius by a sensing offset length, and a sensing element configured to sense that the web material remaining on the roll is depleted when a distance between the sensing element and the sensing portion becomes less than the first radius, wherein said sensing element is a mechanical sensing element that is pivotably arranged so as to be pivoted towards said sensing portion of said roll support, the method comprising the step of arranging said coreless roll on said roll support such that said roll support supports an inner circumference of said roll and said roll extends over said roll support length.

28. The method according to claim 27, wherein said at least one roll expanding portion comprises at least one roll expanding member, providing said first radius, wherein said at least one roll expanding member is resilient.

29. A method for arranging a coreless roll of absorbent paper web material on a roll support comprised in a dispenser comprising a sensing arrangement for indicating depletion of a coreless roll of absorbent paper web material in a dispenser, the sensing arrangement comprising:

a roll support configured to be inserted into an inner circumference of said coreless roll with said roll extending over a roll support length so as to support said coreless roll, said roll support extending along a longitudinal center axis, the roll support comprising:

at least one roll expanding portion extending over a part of said roll support length and having a maximum radial extension defining a first radius from said center axis, and at least one sensing portion, extending longitudinally over another part of said roll support length and having a maximum radial extension defining a second radius from said center axis, wherein said first radius is greater than said second radius by a sensing offset length, and a sensing element configured to sense that the web material remaining on the roll is depleted when a distance between the sensing element and the sensing portion becomes less than the first radius, wherein said sensing element is a mechanical sensing element that is pivotably arranged so as to be pivoted towards said sensing portion of said roll support, the method comprising the step of arranging said coreless roll on said roll support such that said roll support supports an inner circumference of said roll and said roll extends over said roll support length.

30. The method according to claim 29, wherein said at least one roll expanding portion comprises at least one roll expanding member, providing said first radius, wherein said at least one roll expanding member is resilient.

31. A sensing arrangement for indicating the depletion of a coreless roll of absorbent paper web material in a dispenser, the sensing arrangement comprising:

a roll support, configured for supporting an inner circumference of said coreless roll with said roll extending over a roll support length, said roll support extending along a longitudinal center axis, the roll support comprising:

at least one roll expanding portion extending over a part of said roll support length and having a maximum radial extension defining a first radius from said center axis, and at least one sensing portion, extending longitudinally over another part of said roll support length and having a maximum radial extension defining a second radius from said center axis, wherein said first radius is greater than said second radius by a sensing offset length, and a sensing element configured to sense that the web material remaining on the roll is depleted when a distance between the sensing element and the sensing portion becomes less than the first radius; and wherein the sensing element includes a protruding portion that is configured to contact with the coreless roll when the coreless roll is in the dispenser, and the protruding portion pivots about an axis that is parallel to the roll support, wherein said sensing element is a mechanical sensing element that is pivotably arranged so as to be pivoted towards said sensing portion of said roll support.

* * * * *